US006732647B2

(12) United States Patent
Uera et al.

(10) Patent No.: US 6,732,647 B2
(45) Date of Patent: May 11, 2004

(54) PUMP FOR INKING OR LIKE PURPOSES

(75) Inventors: Yoshinori Uera, Kanagawa (JP); Keita Matsuzaka, Tokyo (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/301,603

(22) Filed: Nov. 22, 2002

(65) Prior Publication Data

US 2003/0116043 A1 Jun. 26, 2003

(30) Foreign Application Priority Data

Dec. 25, 2001 (JP) ..... P2001-392377

(51) Int. Cl.[7] ..... B41F 31/02
(52) U.S. Cl. ..... 101/366; 417/481
(58) Field of Search ..... 101/119, 335, 101/305.5, 365, 366, DIG. 45, DIG. 47; 417/2, 62, 286, 426, 481–483, 488, 498, 500

(56) References Cited

U.S. PATENT DOCUMENTS

| | | | | |
|---|---|---|---|---|
| 3,168,872 A | * | 2/1965 | Pinkerton | 417/492 |
| 3,366,051 A | * | 1/1968 | Fusco | 101/365 |
| 5,526,745 A | * | 6/1996 | Uera | 101/366 |
| 5,639,220 A | * | 6/1997 | Hayakawa | 417/53 |

FOREIGN PATENT DOCUMENTS

| | | | |
|---|---|---|---|
| JP | 53-83103 | * | 7/1978 |
| JP | 62-503180 A | * | 12/1987 |
| JP | 07-323520 A1 | | 12/1995 |
| JP | 2864447 B1 | | 3/1999 |
| JP | 2000-130317 A | * | 5/2000 |
| JP | 3095744 B1 | | 10/2000 |
| JP | 2001-063004 A1 | | 3/2001 |

* cited by examiner

*Primary Examiner*—Ren Yan
(74) *Attorney, Agent, or Firm*—Rader, Fishman & Grauer PLLC

(57) ABSTRACT

An inking pump for an offset printing press has a cylinder defining a bore in which a plunger is received for both rotation and linear reciprocation, creating a first and a second opposed fluid chamber. The cylinder has formed therein a first and a second suction port with a spacing therebetween axially of the bore, and, angularly spaced 180 degrees from the suction ports, a first and a second discharge port with an axial spacing therebetween. The plunger has formed in its surface a first recess for placing the first fluid chamber in successive communication with the first suction port and the first discharge port during each complete revolution of the plunger, and a second recess for placing the second fluid chamber in successive communication with the second suction port and the second discharge port during each complete revolution of the plunger. The first and second recesses are angularly spaced 180 degrees from each other about the plunger axis, so that the ink is delivered twice during each complete revolution, with concurrent one complete linear reciprocation, of the plunger.

5 Claims, 6 Drawing Sheets

PUMP FOR INKING OR LIKE PURPOSES

BACKGROUND OF THE INVENTION

1. Field of the Invention

This invention relates generally to pumps, and more particularly to a pump well adapted for use in an inking mechanism of the offset printing press, among other applications. Still more particularly, the invention pertains to a pump of the kind having a piston or plunger slidably received in a bore in a pump housing for joint rotation and linear reciprocation, featuring provisions for making the pump as constant as feasible in the rate of ink or other fluid delivery therefrom.

2. Description of the Prior Art

The inking pump of the kind in question differs from the so-called piston pump or reciprocating pump in that the plunger not only reciprocates linearly but rotates, too, at the same time. This type of pump is per se not new, however. Japanese Patents Nos. 2,864,447 and 3,095,744 are hereby cited as teaching pumps with a reciprocating and rotating plunger. Both of these prior art pumps are alike in requiring two plunger strokes and one revolution to complete a cycle; that is, the fluid is drawn in while the plunger is both traveling linearly in one direction and rotating a half revolution, and forced out while the plunger is both traveling linearly in the other direction and rotating another half revolution.

An objection to these known pumps, particularly in their use as inking pumps in an offset printing press, is that the suction stroke and discharge stroke of the plunger alternate, resulting in intermittent ink discharge. The ink density of the image is the highest at the end of the discharge stroke, diminishes during the ensuing suction stroke, and restarts rising upon commencement of the next discharge stroke. Such cyclic change in ink density presents a bar to the production of high-quality printings. Even totally defective printings may occur depending upon the images being printed, for some such images may be printed densely, and others thinly, to an unacceptable degree.

SUMMARY OF THE INVENTION

The present seeks to make a pump of the kind defined, far more constant than heretofore in the rate of fluid delivery during each cycle of operation and hence, in its intended typical use as an inking pump in an offset printing press, to enable the latter to produce printings of unfluctuating ink density.

Briefly, the present invention may be summarized as a pump suitable for use in an inking mechanism of a printing press, among other applications. Included is a plunger received in a bore in housing means for both angular and linear motion relative to the same, defining a first and a second opposed fluid chamber in the bore. The housing means has formed therein a first and a second suction port with a spacing therebetween axially of the bore, and a first and a second discharge port with a spacing therebetween axially of the bore, there being a preassigned angular spacing about the axis of the bore between the first and second suction ports and the first and second discharge ports, all of the first and second suction ports and the first and second discharge ports being open to the bore. The plunger has formed therein a first recess adjacent a first end thereof and in a first preassigned angular position thereon for placing the first fluid chamber in successive communication with the first suction port and the first discharge port during each complete revolution of the plunger, and a second recess adjacent a second end thereof and in a second preassigned angular position thereon for placing the second fluid chamber in successive communication with the second suction port and the second discharge port during each complete revolution of the plunger.

The plunger is driven for joint angular and linear travel relative to the housing means, making one complete linear reciprocation (i.e. one to-and-fro travel) during each complete revolution, or turning half a revolution during each stroke. During plunger travel from the first toward the second fluid chamber, the fluid will be drawn from the first suction port into the first fluid chamber via the first recess in the plunger and, at the same time, delivered from the second discharge port by being forced out of the second fluid chamber via the second recess in the plunger. During the return stroke of the plunger from the second toward the first fluid chamber, the fluid will be drawn from the second suction port into the second fluid chamber via the second recess in the plunger and, at the same time, delivered from the first discharge port by being forced out of the first fluid chamber via the first recess in the plunger.

Thus the pump draws in the fluid twice, and forces it out twice, during each cycle of operation. Therefore, through appropriate determination of the relative sizes and locations of the suction and discharge ports and the plunger recesses, fluid delivery will continue at all times but when the plunger is at its "dead center" positions at both extremities of its stroke.

Constructed and operating as briefly outlined in the foregoing, the pump according to the present invention is particularly well suited for use in an inking mechanism of an offset printing press, in which application a plurality or multiplicity of pumps, each configured according to the invention, may be juxtaposed for conjoint operation in conformity with the usual practice in the art. The inking pump arrangement according to the invention will cause no such fluctuations in the ink density of the printings as have been conventionally experienced. No overly dense or overly light printings will be produced either, as the pumps are readily adjustable for optimum ink density according to the images being printed, making possible the printing of products that meet the most stringent demands of the clients.

The above and other objects, features and advantages of this invention and the manner of realizing them will become more apparent, and the invention itself will best be understood, from a study of the following description and appended claims, with reference had to the attached drawings showing the preferred embodiment of the invention.

DESCRIPTION OF THE PREFERRED EMBODIMENT

Figure 1:
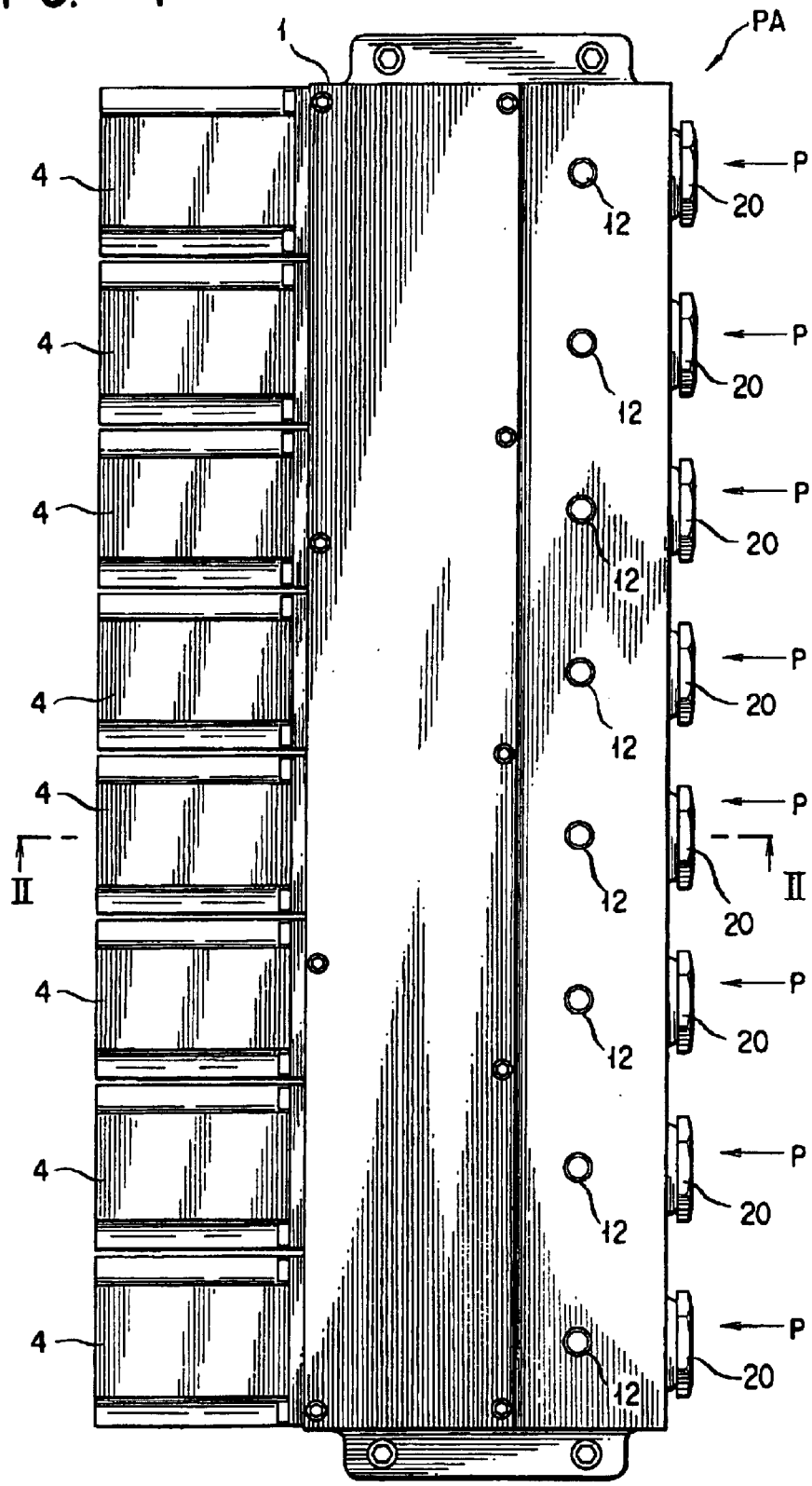
FIG. 1 is a plan view of an inking pump assembly comprising a plurality of pumps in juxtaposition, each constructed in accordance with the novel concepts of this invention, for use in an inking mechanism of an offset printing press by way of a possible application of the invention.

The present invention is believed to be best applicable to the inking mechanism of an offset printing press. FIG. 1 shows an example of such inking mechanism, comprising a plurality of, eight shown, pumps P which are mounted transversely to an elongate mounting base 1 together with associated variable-speed drive motors 4 to make up an inking pump assembly PA. All the inking pumps P are arranged side by side, and so are the drive motors 4. Each inking pump P is of novel construction embodying the principles of the invention.

Figure 2:
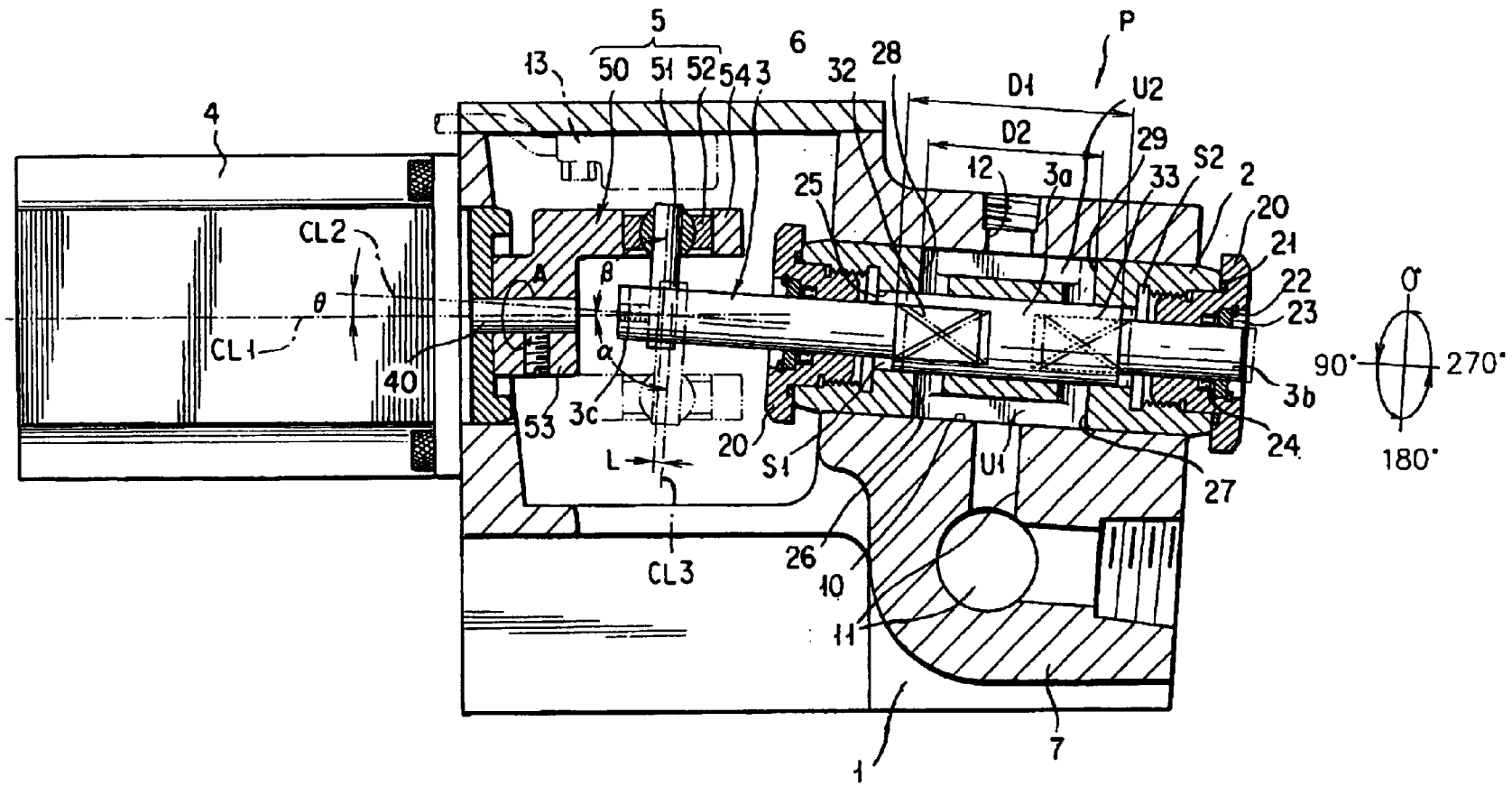
FIG. 2 is an enlarged axial section through each pump of FIG. 1, taken, for example, along the line II—II therein.

As depicted in an enlarged axial section in FIG. 2, each inking pump P is mounted to the base 1 in opposed relationship to one drive motor 4 across an elongate cavity 6 formed longitudinally in the mounting base 1. The inking pump P has a pump housing 7 defining a bore 10 in which a cylinder 2 is immovably received. This cylinder 2 itself has a bore 25 cut axially therethrough in which a plunger or piston 3 is liquid-tightly and slidably fitted for combined linear and angular motion relative to the cylinder. Extending outwardly of the cylinder 2, one end of the plunger 3 is coupled to the drive motor 4 via a motion translating mechanism 5 which converts the rotation of the drive motor into the joint linear reciprocation and rotation of the plunger. The motion translating mechanism 5 lies in the cavity 6 in the mounting base 1.

The cylinder 2 has formed therein a first suction port 26, a second suction port 27, a first discharge port 28 and a second discharge port 29. The two suction ports 26 and 27 are spaced from each other axially of the cylinder 2 and aligned with each other radially of the cylinder 2. The two discharge ports 28 and 29 are likewise spaced from each other axially of the cylinder 2 and aligned with each other radially of the cylinder 2. Further the suction ports 26 and 27 are aligned respectively with the discharge ports 28 and 29; that is, the suction port pair and the discharge port pair are angularly spaced 180 degrees from each other about the axis of the cylinder 2.

Also formed in the cylinder 2 are an suction crossway $U_1$ intercommunicating the suction ports 26 and 27 at their ends radially outwardly of the cylinder, and a discharge crossway $U_2$ intercommunicating the discharge ports 28 and 29 at their ends radially outwardly of the cylinder. The suction crossway $U_1$ is open directly to an ink passageway 11 in the pump housing 7 for communication with an ink reservoir, not shown, via a conduit system, also not shown. The discharge crossway $U_2$ is open directly to a discharge passageway 12 in the pump housing 7 for ink delivery to the ink railing, not shown, which is customarily incorporated in the offset printing press under consideration for ink delivery toward the offset cylinder or cylinders.

The plunger 3 is formed to include a larger-diameter midportion $\mathbf{3}_a$ in sliding, liquid-tight engagement with the cylinder inner surface bounding the bore 25, and a pair of smaller-diameter end portions $\mathbf{3}_b$ and $\mathbf{3}_c$ coaxially extending in opposite directions from the midportion. Thus a pair of fluid chambers $S_1$ and $S_2$ are defined next to the opposite ends of the plunger midportion $\mathbf{3}_a$. The plunger midportion $\mathbf{3}_a$ has an axial dimension $D_1$ that is longer than the maximum distance $D_2$ between the pair of suction ports 26 and 27, and between the pair of discharge ports 28 and 29, by more than the stroke L of the linear reciprocation of the plunger 3.

Formed in the surface of the plunger midportion $\mathbf{3}_a$ are a first recess 32 and a second recess 33 which lie at the opposite axial ends of the plunger midportion and which are circumferentially spaced 180 degrees from each other about the plunger axis. The first recess 32 and second recess 33 are constantly open to the fluid chambers $S_1$ and $S_2$, respectively, regardless of the angular position of the plunger 3 relative to the cylinder 2. These recesses 32 and 33 have each such a dimension axially of the plunger 3 that they remain in register, but not necessarily in communication, with the first suction port 26 and first discharge port 28 and with the second suction port 27 and second discharge port 29, respectively, throughout the stroke L of the plunger. It is thus seen that, with the rotation of the plunger 3, the first recess 32 can place the first fluid chamber $S_1$ alternately in communication with the first suction port 26 and the first discharge port 28, and the second recess 33 can place second fluid chamber $S_2$ alternately in communication with the second suction port 27 and the second discharge port 29.

A pair of headed end caps 20 are screwed into the opposite ends of the cylinder bore 25 for liquid-tightly closing the pair of fluid chambers $S_1$ and $S_2$. The heads of these cylinder end caps 20 are held against the ends of the cylinder 2, with O-ring seals 21 interposed therebetween. The cylinder end caps 20 are themselves bored axially to slidably receive the smaller-diameter end portions $\mathbf{3}_b$ and $\mathbf{3}_c$ of the plunger 3. Additional O-ring seals 24 are mounted between the plunger end portions $\mathbf{3}_b$ and $\mathbf{3}_c$ and the cylinder end caps 20 and locked against displacement by retainer rings 22 via shims 23.

The variable-speed drive motor 4 is mounted opposite the inking pump P across the cavity 6 in the base 1. The axis $CL_1$ of the drive motor 4 is at an angle θ to the axis $CL_2$ of the pump P. A preferred example of the drive motor 4 is the known stepper motor which rotates by discrete increments in response to electric stepping pulses.

Extending into the cavity 6 in the mounting base 1, the output shaft 40 of the drive motor 4 is coupled to the projecting end $\mathbf{3}_c$ of the pump plunger 3 via the noted motion translating mechanism 5. This motion translating mechanism is designed to cause one complete revolution and one linear reciprocation of the pump plunger 3 with each complete revolution of the motor output shaft 40. The motion translating mechanism 5 includes a crank 50 comprising a crank web 53 mounted fast to the motor output shaft 40 and extending right angularly therefrom, and a crankpin 54 joined to the distal end of the crank web 53 and extending parallel to the motor axis $CL_1$. The crankpin 54 is coupled to the pump plunger 3 via a link 51 and a spherical bearing 52.

The link 51 is joined directly to the pump plunger 3 at one end and, at the other end, to the crankpin 54 via the spherical bearing 52. The link 51 has an axis $CL_3$ extending at a predetermined angle of, say, 90 degrees to the axis $CL_2$ of the pump plunger 3. This angle remains unchanged throughout the complete revolution of the crankpin 54 about the motor axis $CL_1$, but the angle between link 51 and crankpin 54 is variable by virtue of the spherical bearing 52.

Also variable is the angle between motor axis $CL_1$ and link axis $CL_3$, minimizing at $\alpha$ when the crank 50 is in the broken-line position of FIG. 2 and maximizing at $\beta$ when the crank is in the solid-line position. The broken- and solid-line positions are angularly spaced 180 degrees from each other. Thanks to the offset arrangement of the motor axis $CL_1$ and pump plunger axis $CL_2$, the pump plunger 3 not only rotates, but linearly reciprocates, relative to the pump cylinder 2 with the revolution of the crank 50. The pump plunger 3 is positioned farthest from the motor 4 when the crank 50 is in the broken-line position, and nearest to the motor when the crank is in the solid-line position, completing one reciprocation with each motor revolution. The farthest position of the pump plunger 3 may be described as the far dead center, and the nearest position as the near dead center, and these plunger positions will be hereinafter referred to as the FDC and NDC, respectively.

Preferably, in the practice of the invention, a crankpin sensor may be provided in the base cavity 6, as indicated in phantom outline and labeled 13 in FIG. 2, for sensing the angular position of the crankpin 54. The crankpin sensor 13 is shown as a proximity switch to be actuated each time the crankpin 54 comes to the solid-line position, bringing the pump plunger 3 to the NDC position.

Operation

The rotation of the drive motor 4 will be imparted to the pump plunger 3 via the crank 50 and link 51. Revolving with the crankpin 54, the link 51 will travel linearly along the pump plunger axis $CL_2$ over the distance L in FIG. 2. Such combined rotary and linear displacement of the link 51 will be wholly transmitted to the pump plunger 3, causing the latter to rotate about its own axis $CL_2$ and reciprocate linearly between the solid-line NDC and broken-line FDC positions.

The two suction ports 26 and 27 and two discharge ports 28 and 29 of the pump P are covered and uncovered, and placed in and out of communication the fluid chambers $S_1$ and $S_2$, by the recessed plunger 3 as the latter rotates and linearly reciprocates as above. The recesses 32 and 33 in the pump plunger 3 are both totally out of communication with the suction ports 26 and 27 and discharge ports 28 and 29, discommunicating them from the fluid chambers $S_1$ and $S_2$, when the plunger is in the solid-line NDC position of FIG. 2. During a half revolution of the pump plunger 3 from this NDC to the broken-line FDC position in the direction indicated by the arrow A in FIG. 2, the first recess 32 will come into register with the first suction port 26 thereby communicating the same with the first fluid chamber $S_1$, whereas the second recess 33 will come into register with the second discharge port 29 thereby communicating the same with the second fluid chamber $S_2$. The suction ports 26 and 27 and discharge ports 28 and 29 will all be reclosed by the pump plunger 3 when the latter arrives at the FDC position.

During the next half revolution of the pump plunger 3 from the FDC back to the NDC position, the first recess 32 will come into register with first discharge port 28 thereby communicating the same with the first fluid chamber $S_1$, whereas the second recess 33 will come into register with the second suction port 27 thereby communicating the same with the second fluid chamber $S_2$. All the suction ports 26 and 27 and discharge ports 28 and 29 will be closed again when the pump plunger 3 comes back to the NDC position.

The operation of the inking pump P, briefly summarized above, will be better understood from the following description of FIGS. 3A–3C through 6A–6C. All these figures are drawn on the assumption that the pump plunger 3 starts rotation in a counterclockwise direction from its solid-line NDC position of FIG. 2. The pump plunger 3 is shown turned 90 degrees from this starting position in FIGS. 3A–3C, 180 degrees in FIGS. 4A–4C, 270 degrees in FIGS. 5A–5C, and 360 degrees in FIGS. 6A–6C.

Figure 3A:
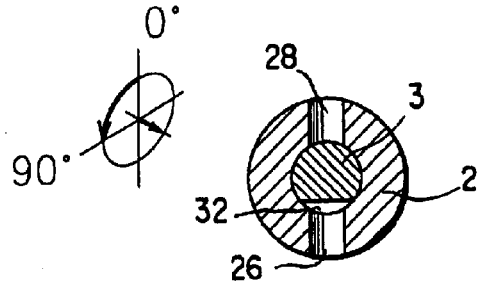
FIGS. 3A, 3B and 3C are views explanatory of the operation of the FIG. 2 pump when the pump plunger is turned 90 degrees from its starting position, FIG. 3B being a perspective view with a part in section, and FIGS. 3A and 3C being cross-sectional views taken respectively along the lines IIIA—IIIA and IIIC—IIIC in FIG. 3B.
Figure 3B:
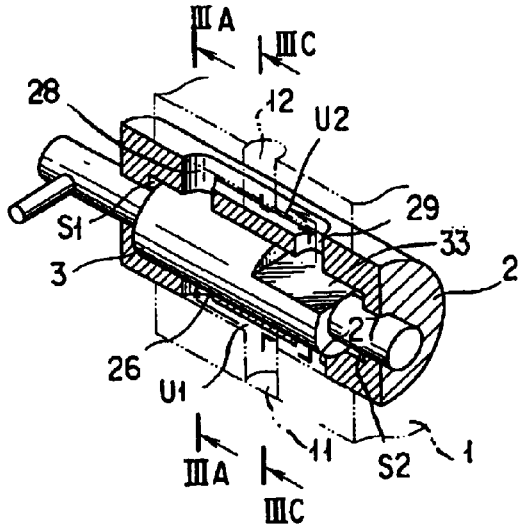
Figure 3C:
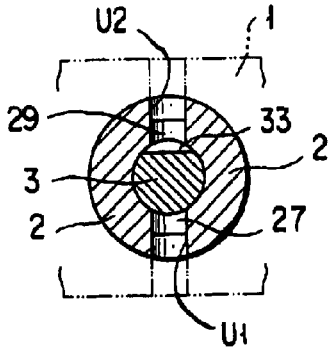

Referring first to FIGS. 3A–3C, it will be seen that the first recess 32 in the pump plunger 3 is positioned to place the first suction port 26 in communication with the first fluid chamber $S_1$, and the second recess 33 to place the second discharge port 29 in communication with the second fluid chamber $S_2$, when the pump plunger 3 is turned 90 degrees from its FIG. 2 starting position. The pump plunger 3 has not only been turned 90 degrees but traveled linearly away from its NDC position, so that the first fluid chamber $S_1$ has correspondingly increased in capacity. The ink will therefore have been drawn from the first suction port 26 into the first fluid chamber $S_1$ via the first recess 32. The second fluid chamber $S_2$, on the other hand, will decrease in capacity, so that the ink that has been filled therein will be forced out the second discharge port 29. This represents the first ink outflow during each cycle of pump operation. The second suction port 27 and first discharge port 28 will both be thoroughly closed in this angular position of the pump plunger 3.

Figure 4A:
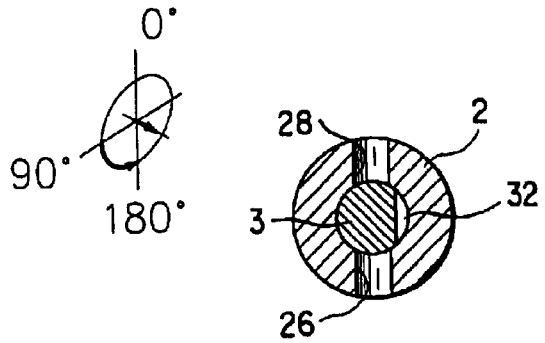
FIGS. 4A, 4B and 4C are views explanatory of the operation of the FIG. 2 pump when the pump plunger is turned another 90 degrees from its FIGS. 3A–3C position, FIG. 4B being a view similar to FIG. 3B, and FIGS. 4A and 4C being cross-sectional views taken respectively along the lines IVA—IVA and IVC—IVC in FIG. 4B.
Figure 4B:
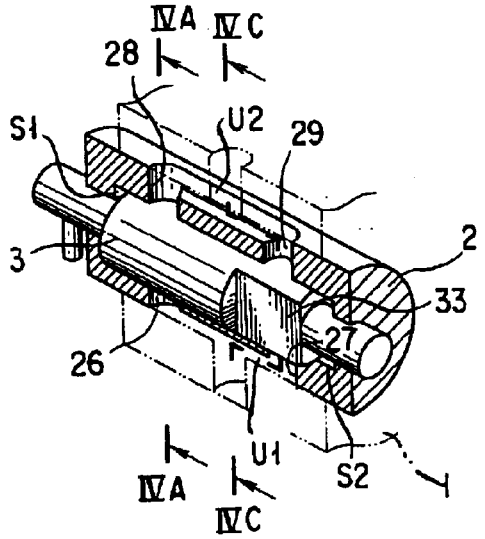
Figure 4C:
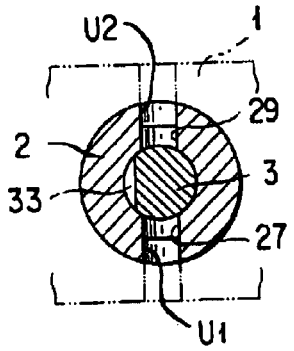

On turning another 90 degrees from its FIGS. 3A–3C position, as illustrated in FIGS. 4A–4C, the pump plunger 3 will arrive at the FDC position indicated by the broken lines in FIG. 2. The two recesses 32 and 33 in the pump plunger 3 will then be in such angular positions relative to the cylinder 2 that the pump plunger will block all of the suction ports 26 and 27 and discharge ports 28 and 29, placing them out of communication with the fluid chambers $S_1$ and $S_2$.

Figure 5A:
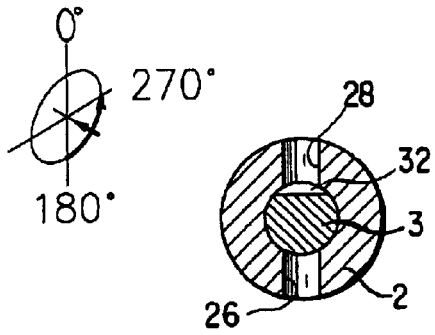
FIGS. 5A, 5B and 5C are views explanatory of the operation of the FIG. 2 pump when the pump plunger is turned another 90 degrees from its FIGS. 4A–4C position, FIG. 5B being a view similar to FIG. 3B, and FIGS. 5A and 5C being cross-sectional views taken respectively along the lines VA—VA and VC—VC in FIG. 5B.
Figure 5B:
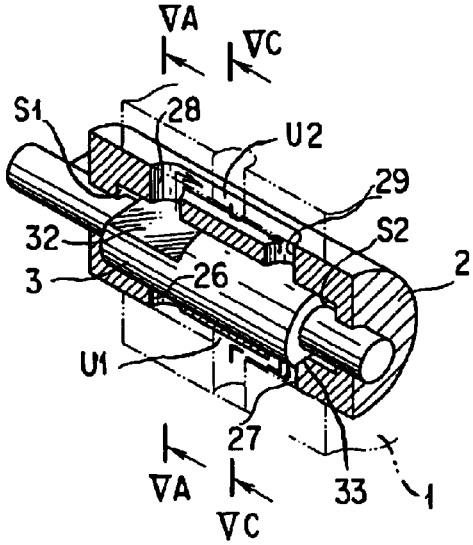
Figure 5C:
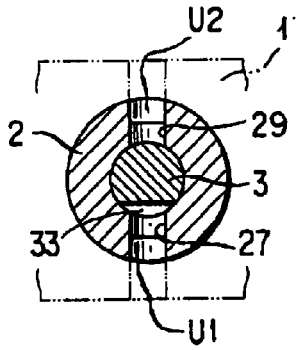

FIGS. 5A–5C show the pump plunger 3 turned still another 90 degrees, and linearly displaced halfway back toward the NDC position, from its FIGS. 4A–4C position. It will be observed that the first fluid chamber $S_1$ communicates with the first discharge port 28 via the first plunger recess 32. As the first fluid chamber $S_1$ decreases in capacity, the ink that has been drawn therein as above will flow out the first discharge port 28, a second ink delivery during one cycle of pump operation. The second fluid chamber $S_2$ communicates with the second suction port 27 via the second plunger recess 33, drawing the ink in with an increase in its capacity. The first suction port 26 and second discharge port 29 will be both completely closed.

Figure 6A:
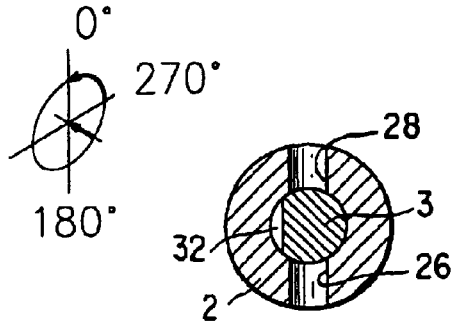
FIGS. 6A, 6B and 6C are views explanatory of the operation of the FIG. 2 pump when the pump plunger is turned another 90 degrees from its FIGS. 5A–5C position back to the starting position, FIG. 6B being a view similar to FIG. 3B, and FIGS. 6A and 6C being cross-sectional views taken respectively along the lines VIA–VIA and VIC–VIC in FIG. 6B.
Figure 6B:
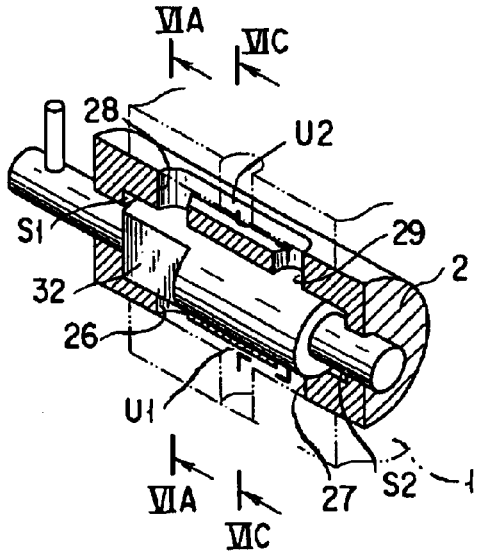
Figure 6C:
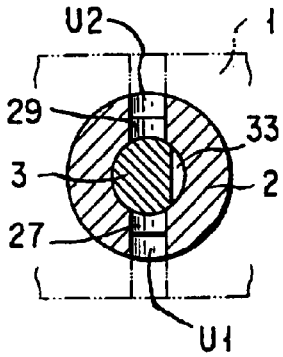

In FIGS. 6A–6C is shown the pump plunger 3 brought back to the NDC position indicated by the solid lines in FIG. 2. The pump plunger 3 will then close all of the suction ports 26 and 27 and discharge ports 28 and 29, placing them out of communication with the fluid chambers $S_1$ and $S_2$. One cycle of operation has now come to an end.

In short the pump P draws the ink alternately into the pair of fluid chambers $S_1$ and $S_2$ via the pair of suction ports 26 and 27 with every 180-degree turn of the pump plunger 3 and delivers the ink alternately from the pair of discharge ports 28 and 29 with every 180-degree turn of the pump plunger. The objective of substantially constant ink delivery is thus accomplished as ink outflow is suspended only when the pump plunger is in the NDC and FDC positions. The O-ring seals 21 will function during such pump operation to prevent ink leakage from between cylinder 2 and cylinder end caps 20, and the O-ring seals 24 to prevent ink leakage from between plunger 3 and cylinder end caps 20.

Although the pump according to the present invention has been shown and described hereinbefore as adapted for use in the inking mechanism of the offset printing press, it is not desired that the invention itself be limited by the exact showing of the drawings or the description thereof. For instance, the pump plunger need not be double-ended as in the illustrated embodiment. The double-ended plunger makes possible the creation of a pair of fluid chambers of equal capacity for ink delivery from both discharge ports 28 and 29 at the same rate. In cases where a difference in the rate of ink or other fluid delivery from the pair of discharge ports is tolerated, the plunger may be single-ended, and the far end of the cylinder may be closed by a solid end cap. Or, with the plunger left double-ended, the pair of smaller diameter end portions thereof may be made different in diameter. These and a variety of other modifications, alterations and adaptations of the invention may suggest themselves to the specialists without departure from the purview of the claims annexed hereto.

What is claimed is:

1. A pump suitable for use in an inking mechanism of a printing press, among other applications, comprising:

housing means including an inner cylinder defining a bore having an axis and an outer cylinder surrounding and fixedly connected to the inner cylinder in a sealed manner the inner cylinder having a first and a second suction port formed therein with a spacing therebetween axially of the bore, and a first and a second discharge port formed therein with a spacing therebetween axially of the bore, there being a preassigned angular spacing about the axis of the bore between the first and second suction ports and the first and second discharge ports, all of the first and second suction ports and the first and second discharge ports being open to the bore, the inner cylinder having an axially-extending suction crossway interconnecting the first and second suction ports and an axially-extending discharge crossway interconnecting the first and second discharge ports, the outer cylinder having a radially-extending discharge passageway in fluid communication with the discharge crossway and a radially-extending fluid passageway in fluid communication with the suction crossway;

a plunger slidably and liquid-tightly fitted in the bore for both rotation and linear reciprocation relative to the housing means, the plunger defining a first and a second opposed fluid chamber in the bore;

a first recess formed in the plunger adjacent a first end thereof and in a first preassigned angular position thereon for placing the first fluid chamber in successive communication with the first suction port and the first discharge port during each complete revolution of the plunger;

a second recess formed in the plunger adjacent a second end thereof and in a second preassigned angular position thereon for placing the second fluid chamber in successive communication with the second suction port and the second discharge port during each complete revolution of the plunger;

whereby, by driving the plunger so as to make one complete linear reciprocation during each complete revolution, the fluid is drawn into the pump twice, and discharged therefrom twice, during each such cycle of pump operation.

2. The pump of claim 1 in combination with drive means coupled to the plunger of the pump for imparting combined rotation and linear reciprocation to the pump plunger relative to the housing means.

3. The pump of claim 2 wherein the drive means comprises:

(a) a variable-speed drive motor; and (b) motion translating means connecting the variable-speed drive motor to the pump plunger for translating the rotation of the former into the combined rotation and linear reciprocation of the latter.

4. The pump of claim 3 wherein the drive motor is mounted to the housing means and has an axis set at an angle to the axis of the pump plunger, and wherein the motion translating means of the drive means comprises:

(a) a crank coupled to the drive motor;

(b) a spherical bearing; and (c) a link coupled at one end to the crank via the spherical bearing and at the other end to the pump plunger.

5. A pump capable of delivering a fluid twice during each cycle of operation, suitable for use in an inking mechanism of a printing press, among other applications, the pump comprising:

housing means including an inner cylinder defining a bore having an axis and an outer cylinder surrounding and fixedly connected to the inner cylinder in a sealed manner the inner cylinder having a first and a second suction port formed therein with a spacing therebetween axially of the bore, and a first and a second discharge port formed therein with a spacing therebetween axially of the bore, there being an angular spacing of 180 degrees about the axis of the bore between the first and second suction ports and the first and second discharge ports, all of the first and second suction ports and the first and second discharge ports being open to the bore, the inner cylinder having an axially-extending suction crossway interconnecting the first and second suction ports and an axially-extending discharge crossway interconnecting the first and second discharge ports, the outer cylinder having a radially-extending discharge passageway in fluid communication with the discharge crossway and a radially-extending fluid passageway in fluid communication with the suction crossway;

a plunger slidably and liquid-tightly mounted in the bore for both rotation and linear reciprocation relative to the housing means, the plunger defining a first and a second opposed fluid chamber in the bore;

a first recess formed in the plunger adjacent a first end thereof for placing the first fluid chamber in successive communication with the first suction port and the first discharge port during each complete revolution of the plunger;

a second recess formed in the plunger adjacent a second end thereof and with an angular spacing of 180 degrees from the first recess about the axis of the bore for placing the second fluid chamber in successive communication with the second suction port and the second discharge port during each complete revolution of the plunger; and drive means coupled to the plunger for imparting combined rotation and linear reciprocation thereto relative to the housing means.

* * * * *